US011768040B2

(12) United States Patent
Touma, Jr.

(10) Patent No.: US 11,768,040 B2
(45) Date of Patent: Sep. 26, 2023

(54) AEROSPACE STRUCTURES COMPRISING HEAT EXCHANGERS, AND RELATED HEAT EXCHANGERS AND APPARATUSES

(71) Applicant: Northrop Grumman Systems Corporation, Falls Church, VA (US)

(72) Inventor: Michael J. Touma, Jr., Palm Beach Gardens, FL (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 0 days.

(21) Appl. No.: 17/651,761

(22) Filed: Feb. 18, 2022

(65) Prior Publication Data

US 2022/0205742 A1 Jun. 30, 2022

Related U.S. Application Data

(63) Continuation of application No. 15/139,233, filed on Apr. 26, 2016, now Pat. No. 11,262,142.

(51) Int. Cl.
*F28F 9/26* (2006.01)

(52) U.S. Cl.
CPC ..... *F28F 9/26* (2013.01)

(58) Field of Classification Search
CPC ..... F28F 9/26; F28F 2275/06; F28D 7/0008; F28D 2021/0021
USPC ..... 165/176
See application file for complete search history.

(56) References Cited

U.S. PATENT DOCUMENTS

| | | | | |
|---|---|---|---|---|
| 2,357,251 A | | 8/1944 | Behr | |
| 2,717,489 A | | 9/1955 | Hasbrouck | |
| 2,792,200 A | | 5/1957 | Huggins et al. | |
| 2,887,304 A | | 5/1959 | Hilliard | |
| 3,250,322 A | | 5/1966 | McCrary et al. | |
| 3,282,052 A | | 11/1966 | Lagelbauer | |
| 3,289,757 A | | 12/1966 | Rutledge | |
| 3,315,739 A | | 4/1967 | Kearney | |
| 3,347,059 A | | 10/1967 | Laing | |
| 3,385,353 A | | 5/1968 | Salvatore et al. | |
| 3,391,016 A | * | 7/1968 | McCrary, Jr. | C04B 41/009 427/249.15 |
| 3,424,240 A | | 1/1969 | Stein et al. | |
| 3,785,435 A | * | 1/1974 | Stein | F28D 9/0012 165/80.1 |
| 3,983,933 A | | 10/1976 | Fletcher et al. | |
| 4,044,825 A | | 8/1977 | Gugenberger et al. | |
| 4,431,050 A | | 2/1984 | Martin | |

(Continued)

FOREIGN PATENT DOCUMENTS

| | | |
|---|---|---|
| EP | 0530181 A1 | 3/1993 |
| EP | 0545842 A1 | 6/1993 |

(Continued)

*Primary Examiner* — Tho V Duong
*Assistant Examiner* — Raheena R Malik
(74) *Attorney, Agent, or Firm* — TraskBritt

(57) ABSTRACT

Heat exchangers include a first heat exchange section joined to a second heat exchange section. In some embodiments, channels of one or more of the heat exchange sections may be positioned such that adjacent channels are collinear in at least one direction. In some embodiments, sidewalls of one or more of the heat exchange sections may exhibit a substantially constant thickness along a section of the heat exchanger that includes the channels.

22 Claims, 4 Drawing Sheets

(56) References Cited

U.S. PATENT DOCUMENTS

| | | | | |
|---|---|---|---|---|
| 4,438,809 | A | 3/1984 | Papis | |
| 4,470,454 | A | 9/1984 | Laughlin et al. | |
| 4,742,866 | A | 5/1988 | Yamanaka et al. | |
| 4,836,276 | A | 6/1989 | Yamanaka et al. | |
| 4,850,426 | A | 7/1989 | Fayolle et al. | |
| 4,934,454 | A | 6/1990 | Vandyke et al. | |
| 5,050,668 | A | 9/1991 | Peterson et al. | |
| 5,051,559 | A | 9/1991 | Wells | |
| 5,060,721 | A | 10/1991 | Darragh | |
| 5,078,206 | A | 1/1992 | Goetz, Jr. | |
| 5,082,050 | A | 1/1992 | Darragh | |
| 5,172,752 | A | 12/1992 | Goetz, Jr. | |
| 5,371,945 | A | 12/1994 | Schnoor | |
| 5,787,977 | A | 8/1998 | Yuasa et al. | |
| 5,878,590 | A | 3/1999 | Kadle et al. | |
| 6,075,226 | A | 6/2000 | Kishbaugh | |
| 6,099,373 | A | 8/2000 | Fernstrum | |
| 6,368,060 | B1 | 4/2002 | Fehrenbach et al. | |
| 6,406,523 | B1 | 6/2002 | Connor et al. | |
| 6,438,936 | B1 | 8/2002 | Ryan | |
| 6,616,737 | B1 | 9/2003 | Evans et al. | |
| 6,692,556 | B2 | 2/2004 | Hayes et al. | |
| 6,715,293 | B2 | 4/2004 | Sillence et al. | |
| 6,764,279 | B2 | 7/2004 | Meshenky | |
| 6,829,884 | B2 | 12/2004 | Fint et al. | |
| 6,988,540 | B2 | 1/2006 | Jensen et al. | |
| 6,998,570 | B1 | 2/2006 | Watkins et al. | |
| 7,127,908 | B2 | 10/2006 | Flaugher et al. | |
| 7,172,016 | B2 | 2/2007 | Meshenky et al. | |
| 7,178,345 | B2 | 2/2007 | Sobel et al. | |
| 7,228,890 | B2 | 6/2007 | Guillaume | |
| 7,278,472 | B2 * | 10/2007 | Meshenky ..... | F04D 29/5826 165/125 |
| 7,337,834 | B2 | 3/2008 | Antonijevic et al. | |
| 7,395,669 | B2 | 7/2008 | Sherwood | |
| 7,614,161 | B2 | 11/2009 | Haurie et al. | |
| 7,861,510 | B1 | 1/2011 | Wilson et al. | |
| 8,806,747 | B2 * | 8/2014 | Guinan ..... | B23H 7/02 219/121.72 |
| 9,046,063 | B2 | 6/2015 | Landgraf | |
| 9,108,282 | B2 | 8/2015 | Guinan et al. | |
| 9,273,632 | B2 | 3/2016 | Ueda | |
| 9,513,059 | B2 | 12/2016 | Maurer | |
| 10,041,747 | B2 | 8/2018 | Hon et al. | |
| 2003/0033801 | A1 | 2/2003 | Hinder et al. | |
| 2003/0182928 | A1 | 10/2003 | Sillence et al. | |
| 2007/0029369 | A1 | 2/2007 | Watkins et al. | |
| 2007/0107885 | A1 | 5/2007 | Guillaume | |
| 2010/0012303 | A1 | 1/2010 | Domen | |
| 2010/0326756 | A1 | 12/2010 | Landgraf | |
| 2012/0096858 | A1 | 4/2012 | Augenblick et al. | |
| 2013/0292098 | A1 | 11/2013 | Jindou et al. | |
| 2014/0034740 | A1 | 2/2014 | Sand | |
| 2014/0238012 | A1 | 8/2014 | Miller | |
| 2015/0000865 | A1 | 1/2015 | Ueda | |
| 2015/0258644 | A1 | 9/2015 | Jordan et al. | |
| 2015/0267645 | A1 | 9/2015 | Ueda | |

FOREIGN PATENT DOCUMENTS

| | | | |
|---|---|---|---|
| EP | 0962738 | A2 | 12/1999 |
| EP | 1363013 | A1 | 11/2003 |
| EP | 1655097 | A1 | 5/2006 |
| EP | 2843213 | A1 | 3/2015 |
| EP | 2096294 | B1 | 7/2015 |
| EP | 2045445 | B1 | 3/2016 |
| GB | 1254372 | A | 11/1971 |
| GB | 1419839 | A | 12/1975 |
| JP | 05-506916 | A | 10/1993 |
| WO | 91/19150 | A1 | 12/1991 |
| WO | 2004/053416 | A1 | 6/2004 |
| WO | 2007/073453 | A2 | 6/2007 |
| WO | 2013/048448 | A1 | 4/2013 |
| WO | 2014/044981 | A1 | 3/2014 |
| WO | 2015/111847 | A1 | 7/2015 |

* cited by examiner

AEROSPACE STRUCTURES COMPRISING HEAT EXCHANGERS, AND RELATED HEAT EXCHANGERS AND APPARATUSES

CROSS-REFERENCE TO RELATED APPLICATION

This application is a continuation of U.S. patent application Ser. No. 15/139,233, filed Apr. 26, 2016, now U.S. Pat. No. 11,262,142, issued Mar. 1, 2022, the disclosure of which is hereby incorporated herein in its entirety by this reference.

TECHNICAL FIELD

Embodiments of the present disclosure relate to heat exchanges for transferring heat energy to and/or from a medium (e.g., a fluid). More particularly, embodiments of the present disclosure relate to heat exchangers having one or more sections that are joined together (e.g., by one or more welded joints) and related assemblies, systems, and methods.

BACKGROUND

Heat exchangers are utilized to transfer heat energy from and/or to an adjacent area. For example, a heat exchanger including heat exchange passages (e.g., cooling passages) may be utilized to transfer heat energy away from heat generating areas of a device to at least partially prevent the generation of heat energy from affecting the performance of the device. The passages are typically filled with a fluid (e.g., a gas and/or liquid) that flows through the passages providing a conduit for the heat. Some devices require close tolerance cooling passages extending along an elongated section of the device that are a challenge to manufacture. Such devices include metallic structures exposed to high heat flux such as a combustor (e.g., for an aircraft engine). In some types of combustors, the passages are required to be relatively small and positioned in close proximity to one another. Generally, these passages are formed as circular apertures in a heat-receiving wall, where each circular aperture is spaced apart from adjacent apertures by solid sections of the wall, which lack such apertures.

The overall length of the heat exchanger passages and the proximity of the passages may make conventional drilling along the length of the passages with a drill bit difficult, if not impossible. For example, the passages in aircraft combustors can be sixteen inches or longer. This length makes use of a conventional drill bit difficult because it is hard to keep the drill bit from penetrating a surface of an interior chamber and/or from drifting into another cooling passage.

Other methods of providing passages with such small diameters in close proximity include machining grooves into the heat exchanger by cutting through a sidewall of the part and then attaching a face sheet to the heat exchanger in order to cover the open grooves. A typical method of attachment of the face sheet is by welding or brazing the face sheet to the part with the machined grooves. For example, one tier welding technique involves forming blind channels in each section of a device and welding those sections together at regions of each section lacking the channels. The blind channels of each section are then connected by machining a connecting channel between each blind channel through a sidewall of the section and then covering the connection channels with a face sheet.

However, these techniques have limitations. For example, when the combustor is cylindrical in shape and exhibits a relatively small diameter, it can be difficult to form the grooves in the part as well as attach the face sheet to the part. Moreover, it is difficult to make select shapes of passages, such as circular passages, when a face sheet must be employed to cover the open passages.

Another method used to achieve circular passages is by machining laterally-extending semicircular grooves in the ends of two or more parts to provide a uniform thickness at the grooves for welding. Heat exchangers formed by such methods are disclosed in U.S. Pat. No. 9,108,282, the disclosure of which is hereby incorporated herein in its entirety by this reference. In such a heat exchanger, each part includes heat exchange channels extending longitudinally through the part and in communication with the lateral semicircular grooves at the ends of each part. The two parts are then mated together at the semicircular grooves. However, this technique requires twice the machining, since the semicircular grooves are required to be formed in both parts.

BRIEF SUMMARY

In some embodiments, the present disclosure comprises a heat exchanger including a body having a longitudinal axis. The body includes a first heat exchange section comprising a first plurality of channels extending through a wall of the first heat exchange section in a direction substantially parallel to the longitudinal axis of the body. At least one channel of the first plurality of channels is positioned adjacent to another channel of the first plurality of channels such that a portion of the at least one channel and a portion of the another channel of the first plurality of channels are collinear in a direction transverse to the longitudinal axis of the body and to a lateral direction of the body. The body further includes a second plurality of channels extending through a wall of the second heat exchange section in a direction substantially parallel to the longitudinal axis of the body. An end of the second heat exchange section is joined to an end of the first heat exchange section. At least some channels of the first plurality of channels are each aligned and in communication with a respective channel of the second plurality of channels. At least one channel of the second plurality of channels is positioned adjacent to another channel of the second plurality of channels such that a portion of the at least one channel and a portion of the another channel of the second plurality of channels are collinear in the direction transverse to the longitudinal axis of the body and to the lateral direction of the body.

In further embodiments, the present disclosure comprises a heat exchanger including a body having a longitudinal axis. The body includes a first heat exchange section comprising a first plurality of channels extending through the first heat exchange section in a direction substantially along the longitudinal axis of the body. At least one channel of the first plurality of channels and an adjacent channel of the first plurality of channels are positioned to intersect a line extending in a direction transverse to the longitudinal axis of the body and to a lateral direction of the body. The body further includes a second heat exchange section comprising a second plurality of channels extending through the second heat exchange section in a direction substantially along the longitudinal axis of the body. An end of the second heat exchange section is joined to an end of the first heat exchange section. At least some channels of the first plurality of channels are each in communication with a respective channel of the second plurality of channels.

In yet further embodiments, the present disclosure comprises a heat exchanger including a first heat exchange section comprising a first plurality of channels extending through a sidewall of the first heat exchange section in a direction substantially along a longitudinal axis of the heat exchanger. A material thickness of the sidewall of the first heat exchange section excluding voids of the first plurality of channels is substantially constant along a lateral portion of the heat exchanger that includes the first plurality of channels. The heat exchanger further includes a second heat exchange section comprising a second plurality of channels extending through a sidewall of the second heat exchange section in a direction substantially along the longitudinal axis of the heat exchanger. An end of the second heat exchange section is abutted and joined to an end of the first heat exchange section. At least some channels of the first plurality of channels are each in communication with a respective channel of the second plurality of channels. A material thickness of the sidewall of the second heat exchange section excluding voids of the second plurality of channels is substantially constant along a lateral portion of the heat exchanger that includes the second plurality of channels.

DETAILED DESCRIPTION

Heat exchangers utilized to transfer heat energy to and/or from one or more structures and/or mediums (e.g., an adjacent structure and/or medium) are described, as are heat exchanger assemblies, systems, and methods of forming heat exchangers. In particular, heat exchangers (e.g., an elongated heat exchanger), or a section of a heat exchanger, having one or more sections that are joined (e.g., by one or more welded joints) are described, as are related assemblies, systems, and methods. In some embodiments, a heat exchanger may include one or more heat exchange sections where each section includes one or more heat exchanger channels extending through the heat exchange section (e.g., along a longitudinal axis or centerline of the heat exchange section). Each heat exchange section may be coupled (e.g., welded at a weld joint) to an adjacent heat exchange section. The weld joint may extend in a direction transverse to (e.g., extending across) the direction in which the heat exchanger channels extend through one or more of the heat exchange sections.

Such heat exchangers may be implemented in a variety of applications. For example, in aerospace structures (e.g., aerospace propulsion structures, such as, aircraft or spacecraft engine combustors, portions of rocket engines or boosters, etc.) and structures used in energy production (e.g., structures utilized in production, transportation, or refining of hydrocarbons, nuclear fuels, etc.).

As used herein, the term "substantially" utilized in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 80.0% met, at least 90.0% met, at least 95.0% met, at least 99.0% met, or even at least 99.9% met.

Figure 1:
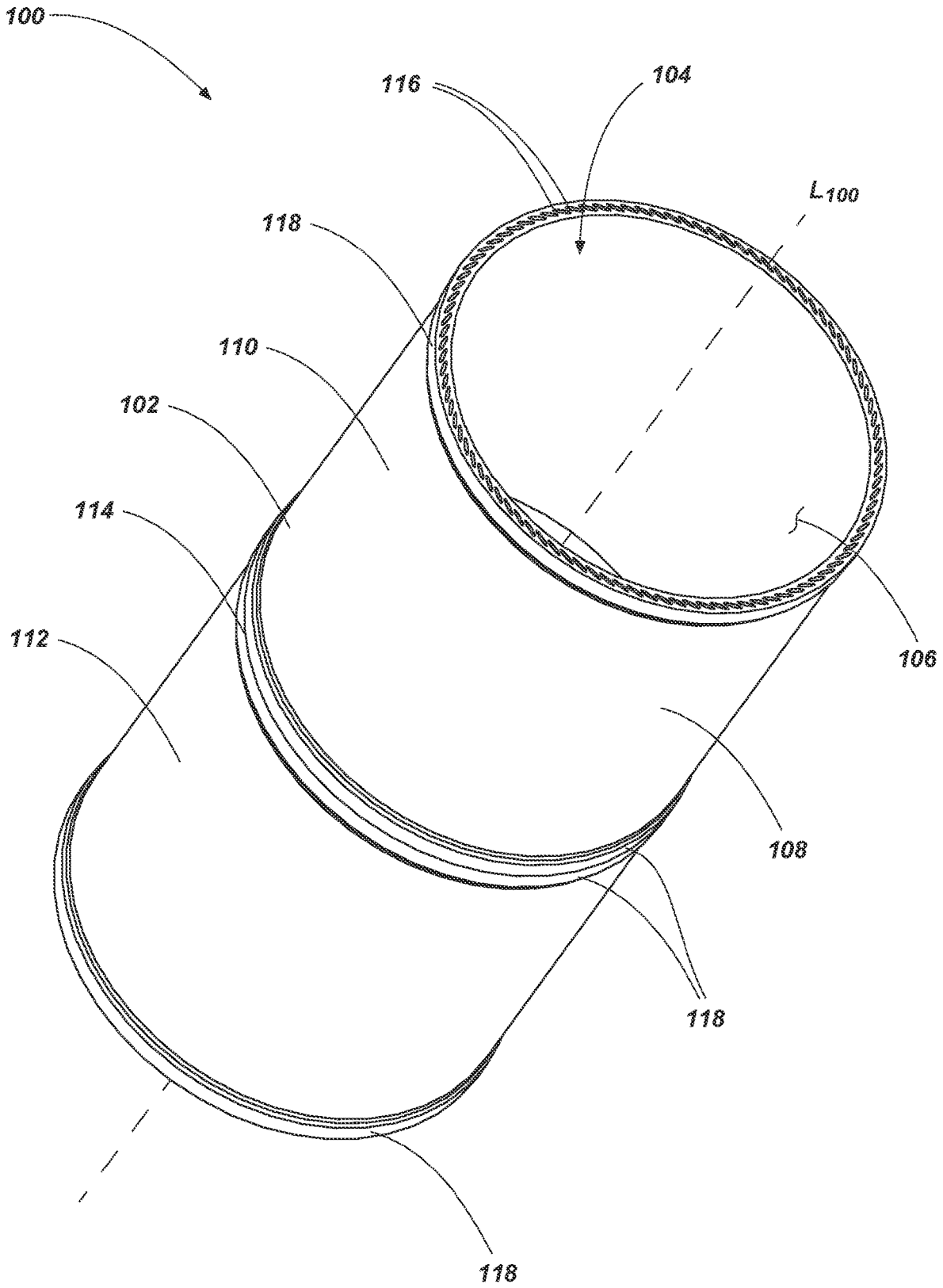
FIG. 1 is an isometric view of a heat exchanger in accordance with an embodiment of the present disclosure.

FIG. 1 shows an isometric view of an embodiment of a heat exchanger 100. Referring to FIG. 1, the heat exchanger 100 includes a body 102. As depicted, a cross-section of the body 102 may exhibit a substantially elliptical shape (e.g., a circular shape), which may particularly useful when the heat exchanger 100 is implemented in an aerospace engine structure. However, in other embodiments, the body 102 may exhibit any other suitable cross-sectional shape for a given application, such as, for example, a planar or polygonal shape (e.g., FIG. 6, discussed below), a curved or other nonlinear shape, or combinations thereof.

In embodiments where the body 102 exhibits a substantially elliptical cross-sectional shape, the body 102 of the heat exchanger 100 may define a passage 104 through which one or more matter (e.g., a medium, a fluid, a material including fluid with solids dispersed therein, an otherwise flowable material, etc.) may pass. The body 102 has an inner surface 106 surrounding and defining the passage 104 and an outer surface 108 opposing the inner surface 106 and the passage 104. In some embodiments, the inner surface 106 may be employed as a heat-absorbing surface that is configured to receive heat energy from the matter passing through the passage 104 (e.g., a fluid flowing through the passage 104). In additional embodiments, the outer surface 108 may be employed as a heat-absorbing surface that is configured to receive heat energy. For example, the outer surface 108 may act to transfer heat from a material outside of the body 102 and into the matter in the passage 104.

As depicted, the heat exchanger 100 includes one or more sections (e.g., first section 110 and second section 112) that are joined together longitudinally at an interface (e.g., a welded joint 114). Although two sections 110, 112 are depicted in FIG. 1, any number of sections may be implemented to define the heat exchanger 100.

In embodiments where a welded joint 114 is implemented, the welding process may comprise one or more of a fusion welding process (e.g., an electron-beam welding process (EBW), laser beam welding), a gas metal arc welding process (MIG), a gas tungsten arc welding process (TIG), and other types of welding.

The first and second sections 110, 112 of the heat exchanger 100 may each include a plurality of channels 116 extending through each section 110, 112. The channels 116 may be aligned along a length of the first and second sections 110, 112 of the heat exchanger 100. For example, the channels 116 may be aligned in a direction or arc that is substantially coextensive (e.g., nonintersecting or parallel) with a longitudinal axis $L_{100}$ (e.g., centerline) of the heat exchanger 100.

Depending on the application, the channels 116 may be configured to receive a liquid in the channels 116 in order to cool or heat matter adjacent to the channels 116 (e.g., a fluid flowing through the passage 104 of the body 102).

The welded joint 114 may extend in a direction transverse (e.g., extending across or substantially perpendicular) to the direction in which the channels 116 extend through the heat exchanger 100. For example, the channels 116 may extend in a direction at least partially along the longitudinal axis $L_{100}$ of the heat exchanger 100. In some embodiments, the channels 116 may extend in a direction substantially parallel to the longitudinal axis $L_{100}$. In some embodiments, the welded joint 114 may extend in a direction transverse to (e.g., perpendicular to) the longitudinal axis $L_{100}$ of the heat exchanger 100.

The welded joint 114 may extend through at least a majority (e.g., an entirety) of the body 102 of the heat exchanger 100 in one direction (e.g., in the direction transverse to the direction in which the channels 116 extend through the heat exchanger 100). For example, the welded joint 114 may extend from the outer surface 108 to the inner surface 106 of the heat exchanger 100. Such a configuration may maximize the amount of material of sections 110, 112 coupled together (e.g., maximize the surface area being coupled) at the welded joint 114 to enhance the overall strength of the welded joint 114.

In some embodiments, the channels 116 may extend around a circumference of the body 102 and each channel 116 may be equally circumferentially spaced relative to one or more adjacent channels 116.

The plurality of channels 116 extending through each section 110, 112 may be defined in the section 110, 112 prior to the sections 110, 112 being joined to define the body 102 of the heat exchanger 100. For example, the plurality of channels 116 may be preformed in each section 110, 112 prior to welding to another section 110, 112. In some embodiments, the plurality of channels 116 may be formed in each section 110, 112 through one or more processes, such as, for example, a drilling process, a milling process, a casting process, a wire electrical discharge machine (EDM) process, additive manufacturing, combinations thereof, or any other suitable process.

As discussed in further detail below, the shape and spacing of the channels 116 may enable the sections 110, 112 of the heat exchanger 100 to be joined (e.g., welded) while still maintaining the integrity of the channels 116, which have been formed (e.g., preformed) through the sections 110, 112. For example, the channels 116 of the sections 110, 112 of the heat exchanger 100 may extend from one end of the section 110, 112 to another opposing end of the section 110, 112, through an entirety of a depth of the section 110, 112 prior to the sections 110, 112 being joined together and the shape and spacing of the channels 116 may enable joining of the sections 110, 112 without causing significant damage to the channels 116 (e.g., minimal to no decrease in the functionality of the channels 116) during the joining process.

In some embodiments, the sections 110, 112 of the heat exchanger 100 may include radially extending, raised or lip portions 118 on either side or end (e.g., sides or ends positioned along the longitudinal axis $L_{100}$ of the heat exchanger 100) of the sections 110, 112. For example, the lip portions 118 may have a thickness (e.g., a radial thickness) that is greater than an adjacent portion of the body 102. In such an embodiment, the relatively thicker lip portions 118 may provide a larger surface area of each section 110, 112 in order to enhance the connection of one section 110, 112 of the heat exchanger 100 to adjacent sections 110, 112 of the heat exchanger 100.

Figure 2:
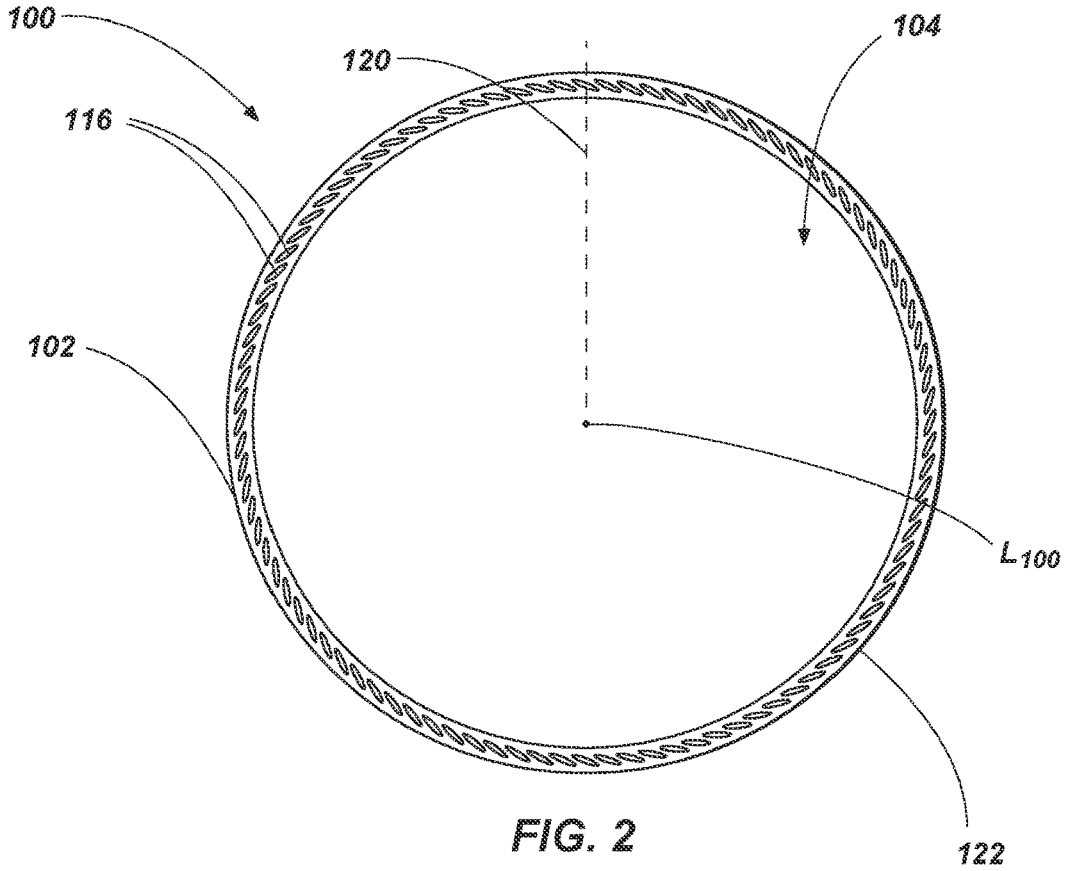
FIG. 2 is an end view of the heat exchanger of FIG. 1 showing the plurality of channels in the circular heat exchanger.
Figure 3:
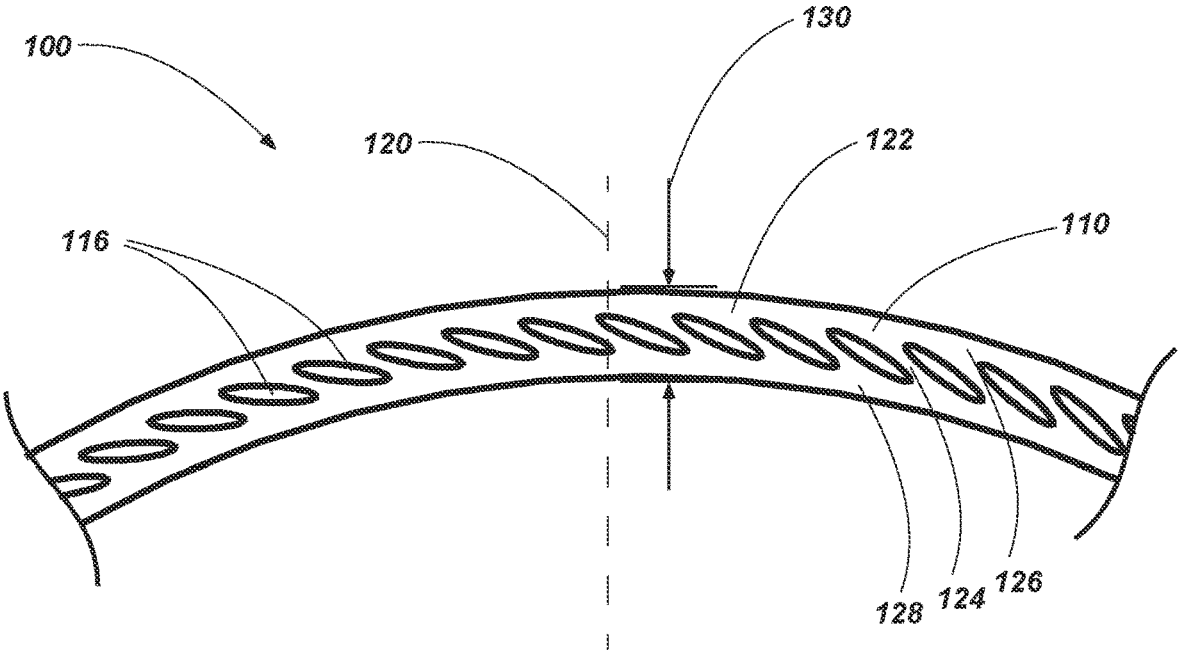
FIG. 3 is an enlarged end view of a portion of the heat exchanger of FIGS. 1 and 2 showing the plurality of channels in the circular heat exchanger.

FIG. 2 is an end view of the heat exchanger 100 of FIG. 1 showing the plurality of channels 116 in the circular heat exchanger 100 and FIG. 3 is an enlarged end view of a portion of the heat exchanger 100 showing the plurality of channels 116 in the circular heat exchanger 100. Referring to FIGS. 1 through 3, each of the channels 116 may be positioned such that the channels 116 are at least adjacent to or bordering (e.g., at least partially overlapping) one another in one or more directions transverse (e.g., perpendicular) to the longitudinal axis $L_{100}$ of the heat exchanger 100 (e.g., radial and circumferential directions). For example, the channels 116, oriented and extending along the circumference of the heat exchanger 100, are at least partially overlapped (e.g., along the circumference of the body 102) such that any cross section of the heat exchanger 100 in a section of the heat exchanger 100 including the channels 116 that is taken perpendicular to the longitudinal axis $L_{100}$ of the heat exchanger 100 will intersect one or more channels 116 in the body 102 (e.g., sidewall 122 of the body 102) of the heat exchanger 100. Stated another way, any cross section of the heat exchanger 100 in a section of the heat exchanger 100 including the channels 116 that is taken perpendicular to the longitudinal axis $L_{100}$ of the heat exchanger 100 will not intersect a portion of the sidewall 122 that lacks a channel 116 extending through the sidewall 122 (e.g., a section including only uninterrupted material that defines the sidewall 122). For example, as shown in FIG. 3, any radial axis (e.g., radial reference line 120) that extends outward from a central portion of the heat exchanger 100 (e.g., the longitudinal axis $L_{100}$ of the heat exchanger 100) will intersect one or two channels 116 of the heat exchanger 100.

Stated in yet another way, the channels 116 are positioned along a length of the sidewall 122 (e.g., the circumference of the heat exchanger 100) such that at least a portion of one channel 116 is collinear with at least a portion of an adjacent channel 116. For example, a portion of one channel 116 and a portion of an adjacent channel 116 are collinear (e.g., each channel 116 has at least one point on the same straight line) in a direction transverse to the longitudinal axis $L_{100}$ of the heat exchanger 100 and to the length of the sidewall 122 (e.g., where the length of the sidewall 122 extends along the channels 116).

As further shown in FIG. 3, the sidewall 122 of the heat exchanger 100 may include a middle portion, which may be characterized as webbing 124 of the sidewall 122 extending between an outer portion 126 and an inner portion 128 of the sidewall 122 that separates each of the channels 116. The channels 116 may be positioned such that a majority of the webbing 124 of the sidewall 122 extends in a direction that is oblique (e.g., not parallel or perpendicular) with respect to a radial axis of the heat exchanger 100 (e.g., radial reference line 120). In some embodiments, the channels 116 may be positioned such that a majority of the webbing 124 of the sidewall 122 extends in a direction (e.g., line or an arc) that is divergent (e.g., not coextensive) with the length (e.g., circumference) of the sidewall 122.

Such a configuration may provide the sidewall 122 with a substantially uniform cross-sectional material thickness 130 where the thickness of the voids defined by the channels 116 are excluded (e.g., subtracted from) cross-sectional material thickness 130. In other words, only the material forming the sidewall 122 (e.g., not the voids in the material)

may exhibit a substantially uniform cross-sectional thickness 130 (e.g., where each cross section is within ±20%, 10%, 5%, 1%, or less (e.g., substantially 0%) of the remaining cross sections) where the thickness of the voids defined by the channels 116 is not included in the measurement of the actual material of the sidewall 122. For example, a cross-sectional thickness 130 of the material of the sidewall 122, where the thickness 130 taken in a radial direction and perpendicular to and at any location along the longitudinal axis $L_{100}$ of the heat exchanger 100 will intersect a void of at least one channel 116 and exhibit a thickness 130 that is substantially uniform with any other similar material thickness 130 taken in a radial direction and perpendicular to and at any location along the longitudinal axis $L_{100}$ of the heat exchanger 100 (e.g., the variation in each cross section is less than ±20%, 10%, 5%, 1%, or less as compared to cross sections taken in other portions of the sidewall 122).

As depicted in FIG. 3, the channels 116 may exhibit an elliptical, but non-circular, cross-sectional shape. For example, the channels 116 may each exhibit a cross-sectional shape of an elongated ellipse having a major axis and a minor axis, where the major axis is greater in length than the minor axis. The major axis of each channel 116 may extend in a direction transverse, but not perpendicular (e.g., at an oblique angle) to the thickness of the sidewall 122 of the heat exchanger 100. Such a configuration enables the elliptical channels 116 to be positioned substantially continuously along a lateral direction of the heat exchanger 100 that is transverse (e.g., perpendicular) to the longitudinal axis $L_{100}$ of the heat exchanger 100 (e.g., along the circumference of the heat exchanger 100). For example, the channels 116 are positioned along the circumference of the heat exchanger 100 such that one channel 116 begins at least at a location substantially where another channel 116 ends, without lateral sections of sidewall 122 that lack any channels 116 extending between the channels 116. In some embodiments, along the circumference of the heat exchanger 100, there are portions where at least two channels 116 will be intersected by a line extending in a radial direction from longitudinal axis $L_{100}$ of the heat exchanger 100.

Figure 4:
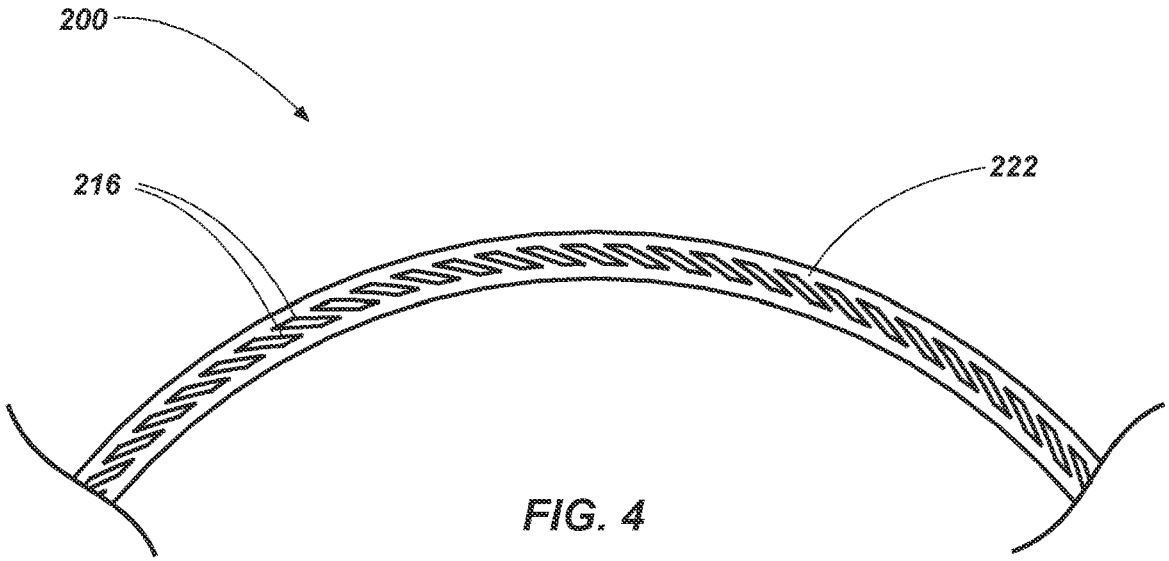
FIG. 4 is an enlarged end view of a portion of the circular heat exchanger showing a plurality of channels in the heat exchanger in accordance with an embodiment of the present disclosure.

FIG. 4 is an enlarged end view of a portion of a circular heat exchanger 200 showing a plurality of channels 216 in the heat exchanger 200 that may be similar and include the same or similar elements as the heat exchanger 100 discussed above. As shown in FIG. 4, the channels 216 may exhibit a polygonal cross-sectional shape (e.g., a quadrilateral cross-sectional shape having a major axis and a minor axis). For example, the channels 216 may each exhibit the cross-sectional shape of a parallelogram having a major axis and a minor axis, where the major axis is greater in length than the minor axis. The major axis of each channel 216 may extend in a direction transverse, but not perpendicular (e.g., at an oblique angle) to a thickness of a sidewall 222 of the heat exchanger 200. As above, such a configuration enables the parallelogram channels 216 to overlap along a lateral direction of the heat exchanger 200 that is perpendicular to a longitudinal axis of the heat exchanger 200 (e.g., along the circumference of the heat exchanger 200). In other words, along the circumference of the heat exchanger 200, there are portions where at least two channels 216 will reside intersected by a line extending in a radial direction from the longitudinal axis $L_{100}$ of the heat exchanger 200.

Figure 5:
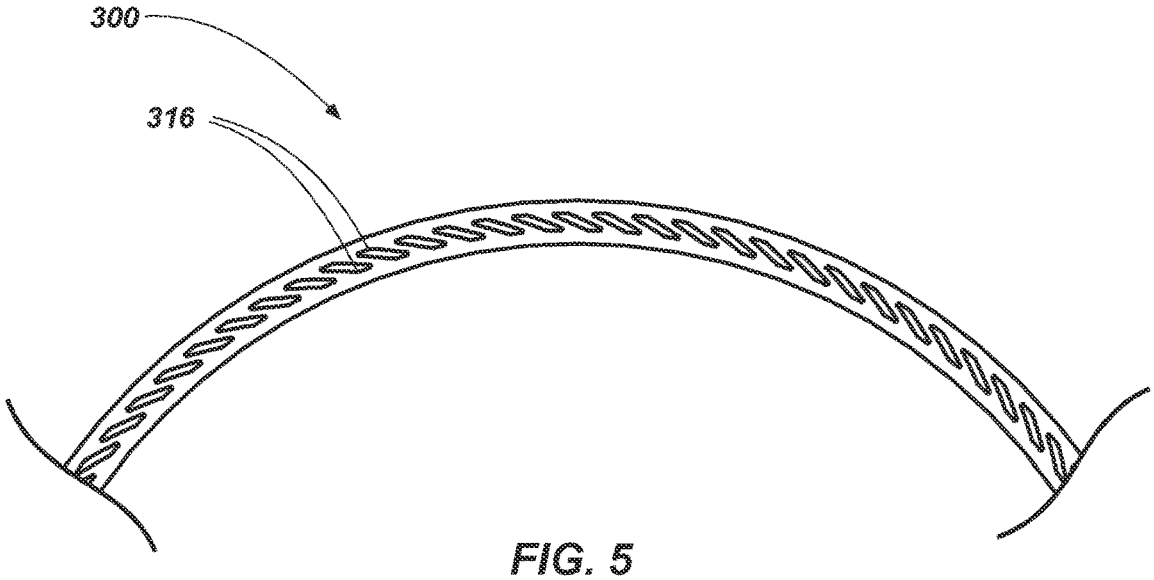
FIG. 5 is an enlarged end view of a portion of the circular heat exchanger showing a plurality of channels in the circular heat exchanger in accordance with an embodiment of the present disclosure.

FIG. 5 is an enlarged end view of a portion of a circular heat exchanger 300 showing a plurality of channels 316 in the heat exchanger 300 that may be similar and include the same or similar elements as the heat exchangers 100, 200 discussed above. As shown in FIG. 5, the channels 316 may exhibit a substantially polygonal cross-sectional shape (e.g., a quadrilateral cross-sectional shape having a major axis and a minor axis). However, the corners (e.g., four corners) of the quadrilateral channel 316 may be rounded or radiused. For example, the channels 316 may each exhibit the cross-sectional shape of a parallelogram having rounded or radiused corners and a major axis and a minor axis, where the major axis is greater in length than the minor axis.

Figure 6:
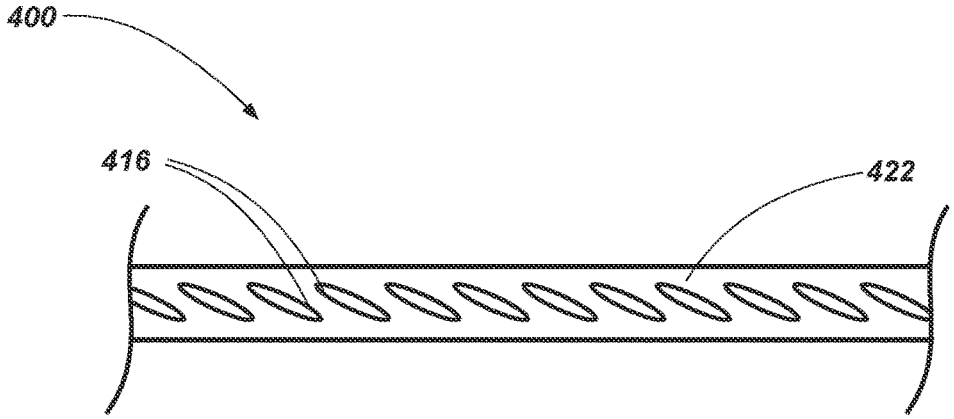
FIG. 6 is an enlarged end view of a portion of a planar heat exchanger showing a plurality of channels in the planar heat exchanger in accordance with an embodiment of the present disclosure.

FIG. 6 is an enlarged end view of a portion of a heat exchanger 400 showing a plurality of channels 416 in the heat exchanger 400 that may be similar and include the same or similar elements as the heat exchangers 100, 200, 300 discussed above. As shown in FIG. 6, the heat exchanger 400 may exhibit a planar or a linear configuration (e.g., as opposed to the circular heat exchangers 100, 200, 300 discussed above). As above, a major axis of each channel 416 (e.g., elliptical channels, quadrilateral channels, etc.) may extend in a direction transverse, but not perpendicular (e.g., at an oblique angle) to a thickness of a sidewall 422 of the heat exchanger 400. Such a configuration enables the channels 416 to overlap along a lateral direction of the heat exchanger 400 that is perpendicular to the longitudinal axis of the heat exchanger 400 (e.g., along a major length of the heat exchanger 400).

Figure 7:
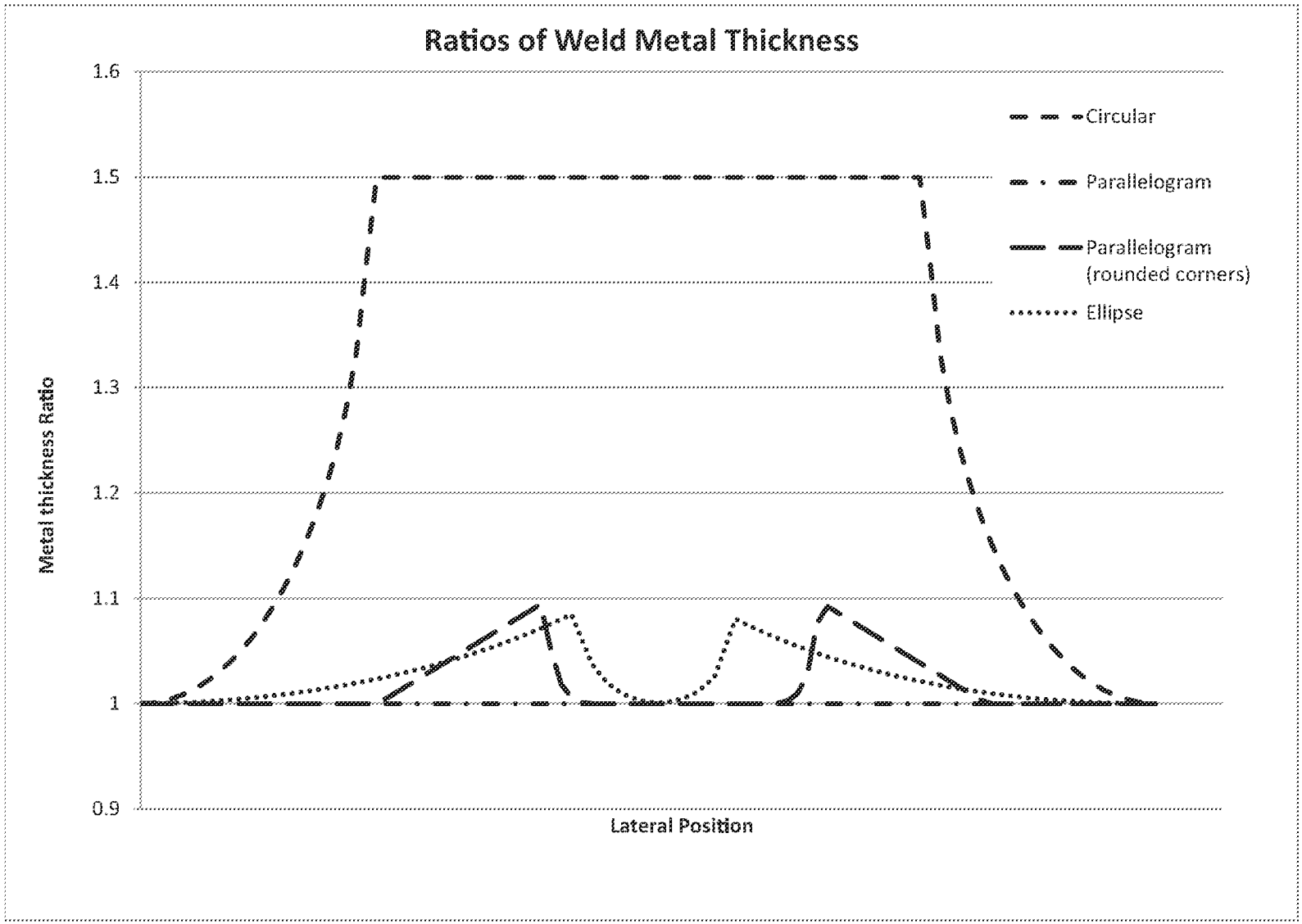
FIG. 7 is a graph illustrating the variation in wall thickness of heat exchangers in accordance with embodiments of the current disclosure as compared to a conventional heat exchanger having spaced circular channels.

FIG. 7 is a graph illustrating the variation in wall thickness of heat exchangers in accordance with embodiments of the instant disclosure as compared to a conventional heat exchanger having spaced circular channels. As shown in FIG. 7, the variation in wall thickness of a conventional heat exchanger including spaced-apart circular channels is compared to heat exchangers including parallelogram cross-sectional shaped channels (e.g., heat exchanger 200 shown in FIG. 4), parallelogram cross-sectional shaped channels with rounded corners (e.g., heat exchanger 300 shown in FIG. 5), and elliptical cross-sectional shaped channels (e.g., heat exchangers 100, 400 shown in FIGS. 1 through 3 and 6). The x-axis represents positions along a lateral direction of the heat exchanger (e.g., in a direction transverse to the length of the channels and perpendicular to a thickness of the sidewall where the panel is located) starting at a middle portion of one channel and ending at a middle portion of an adjacent channel. For example, in a conventional heat exchanger having spaced circular channels, the far left of the x-axis represents a lateral position where the central part of a circular channel is located, the middle portion of the x-axis represents a portion of the heat exchanger wall where no channel is located, and the far right of the x-axis represents a lateral position where the central part of another circular channel is located. For heat exchangers in accordance with embodiment of the instant disclosure lacking a portion where no channel is located, the far left of the x-axis represents a lateral position where the central part of a channel (e.g., an elliptical or parallelogram cross-sectional shaped channel) is located and the far right of the x-axis represents a lateral position where the central part of another channel is located.

As shown in the graph, the wall thickness, which includes only the portion of the wall formed by a material while excluding the voids of the channels, of a conventional heat exchanger having spaced circular channels includes relatively large differences in wall thickness (excluding the voids of the circular channels) depending on lateral position (e.g., up to a 1.5 times or ±35% difference between the respective wall thicknesses) between the portion of the wall (e.g., sidewall) including circular channels and adjacent portions lacking the circular channels that are positioned between the spaced-apart circular channels. The graph further illustrates that heat exchangers having overlapping channels, in accordance with embodiments of the instant disclosure, exhibit significantly lower amounts of variation in sidewall thickness. For example, heat exchangers having the elliptical cross-sectional channels or parallelogram cross-sectional shaped channels with rounded corners exhibit relatively smaller variations in wall thickness (excluding the voids of the channels) of less than a 1.1 times or less than ±10% difference in wall thicknesses depending on lateral position along the heat exchanger. Further, heat exchangers having the parallelogram cross-sectional shaped channels exhibit substantially no variation in wall thickness (excluding the voids of the channels) depending on lateral position along the heat exchanger.

Maintaining a substantially constant wall thickness (e.g., an average thickness of material defining the sidewall) enables relatively more efficient and reliable coupling of multiple heat exchange sections. For example, maintaining an average thickness of material defining the sidewall, with channels extending through the sidewall, enables sections of the heat exchanger to be welded together in an efficient and effective manner. In particular, in a welding process, such as, for example, an electron-beam welding process, the power of the beam is selected based on thickness of the material that is being welded together. In a conventional heat exchanger having spaced circular channels, the greatest thickness is generally selected to ensure that the weld joint extends through an entirety of the sidewall. However, as discussed above, in regions where the channels are located, the material thickness of the sidewall is significantly less (e.g., up to 35% less). Such a lower amount of material thickness in the sidewall is often not able to handle the higher power beam, resulting in damage to the sidewall and/or the channels in the sidewall (e.g., collapse of the sidewall).

Embodiments of the present disclosure may be particularly useful in providing heat exchangers having one or more sections that are joined (e.g., via a welding process) where heat exchange channels are defined in sections of the heat exchanger before the sections are joined together to form the heat exchanger (e.g., an elongated heat exchanger). In particular, the channels of each section of the heat exchanger may exhibit an overlapping configuration in at least one direction to provide a substantially consistent average sidewall material thickness. As discussed above, such a substantially consistent sidewall material thickness enables joining of the heat exchange sections (e.g., through a welding process, such as an electron beam weld) using a process that is selected based on the substantially consistent sidewall material thickness, without having to subject relatively less thick portions of the sidewall to processes that have been selected based on the relatively thicker portions of the sidewall. Such a configuration enables the formation of a joint (e.g., a weld joint) along the heat exchanger that spans a majority and/or an entirety of the width or thickness of the weld joint (e.g., from an inner portion of a sidewall, through a middle portion or webbing of a sidewall, and to an outer portion of a sidewall) without causing unacceptable damage or otherwise blocking the channels.

Further, utilizing the configurations and methods of embodiments of the instant disclosure enables the heat exchange channels to be isolated from one another throughout the length of the heat exchanger, as compared to the above-described techniques requiring semicircular grooves that place all of the channels in communication with one another. For example, as discussed above, heat exchangers including grooves formed in each end (such as those described in U.S. Pat. No. 9,108,282) place every channel in communication with the other channels at the laterally-extending grooves. However, embodiments of the instant disclosure remove the need for such groove, enabling the channels to remain isolated from one another. The weld joint may also surround each of the channels at the joint, reducing the chance of inadvertently placing one channel in communication with another channel through the welding process. Such mutually isolated channels may provide enhanced heat exchange in systems where a portion of the heat exchanger may be susceptible to relatively higher or lower temperatures (e.g., overheating). For example, such a configuration in a heat exchanger may act to isolate channels having overheated fluid enabling the other channels to still effectively transfer heat as the other channels are not in direct communication with the fluid from the overheated channels.

While particular embodiments of the disclosure have been shown and described, numerous variations and alternate embodiments encompassed by the present disclosure will occur to those skilled in the art. Accordingly, the disclosure is only limited in scope by the appended claims and their legal equivalents.

What is claimed is:

1. An aerospace structure, comprising:

an aerospace engine structure comprising a heat exchanger, the heat exchanger comprising:

a body surrounding a longitudinal axis, the body comprising:

a first heat exchange section comprising an inner surface and an outer surface defining a sidewall, the first heat exchange section comprising:

at least one channel within the sidewall and extending in a direction substantially parallel to the longitudinal axis of the body; and one or more adjacent channels at least partially aligned with the at least one channel and positioned such that at least a portion of the at least one channel and at least a portion of the one or more adjacent channels overlap one another such that the at least a portion of the at least one channel and the at least a portion of the one or more adjacent channels are intersected by a first line intersecting the longitudinal axis in a first direction in a plane and a second line extending in a second direction in the plane and intersecting the first direction, the at least a portion of the at least one channel and the at least a portion of the one or more adjacent channels intersected by the first line and the second line having a length along the longitudinal axis greater than a thickness of the sidewall between the inner surface and the outer surface; and a second heat exchange section coupled to the first heat exchange section, the second heat exchange section comprising at least one channel extending in the direction parallel with the longitudinal axis of the body.

2. The aerospace structure of claim 1, wherein any radial axis extending radially from a central portion of the body intersects one or two channels of the first heat exchange section.

3. The aerospace structure of claim 1, wherein each channel of the first heat exchange section is equally circumferentially spaced from neighboring channels.

4. The aerospace structure of claim 1, wherein the sidewall comprises a middle portion extending between an inner portion of the sidewall and an outer portion of the sidewall, the middle portion separating the at least one channel from the one or more adjacent channels.

5. The aerospace structure of claim 4, wherein the middle portion extends in a direction that is not parallel to and not perpendicular to the thickness of the sidewall.

6. The aerospace structure of claim 1, wherein the at least one channel and the one or more adjacent channels each exhibit an elliptical cross-sectional shape, a parallelogram cross-sectional shape, or a polygonal cross-sectional shape.

7. The aerospace structure of claim 1, wherein a cross-sectional shape of each of the at least one channel and the one or more adjacent channels is elliptical.

8. The aerospace structure of claim 7, wherein a major axis of the elliptical cross-sectional shape of the at least one channel extends in a direction that is oblique to the thickness of the sidewall at a location of the at least one channel.

9. The aerospace structure of claim 1, wherein the second heat exchange section is coupled to the first heat exchange section at a weld joint extending along a circumference of the first heat exchange section and the second heat exchange section.

10. The aerospace structure of claim 1, wherein the body comprises raised portions at longitudinal ends of the first heat exchange section and the second heat exchange section, the thickness of the sidewall greater at the raised portions than at other portions of the sidewall.

11. An apparatus, comprising:

a heat exchanger comprising:

a first heat exchange section comprising a first plurality of channels extending through a wall of the first heat exchange section and along a longitudinal axis of the first heat exchange section, at least one channel of the first plurality of channels at least partially overlapping an adjacent channel of the first plurality of channels such that a line intersecting the longitudinal axis and extending in a radial direction intersects the at least one channel of the first plurality of channels and the adjacent channel of the first plurality of channels;

a second heat exchange section comprising a second plurality of channels extending through a wall of the second heat exchange section and along a longitudinal axis of the second heat exchange section, at least some channels of the second plurality of channels individually in communication with a respective channel of the first plurality of channels; and a weld joint joining the first heat exchange section and the second heat exchange section, the weld joint extending around a majority of an interface between the first heat exchange section and the second heat exchange section.

12. The apparatus of claim 11, wherein the heat exchanger comprises a portion of an aircraft engine combustor, a spacecraft engine combustor, a portion of a rocket engine, or a portion of a rocket booster.

13. The apparatus of claim 11, wherein the wall of the first heat exchange section exhibits a variation in thickness in the radial direction that is less than about ±20%, the thickness defined as a thickness of a material of the wall and not including voids defining the channels of the first plurality of channels.

14. The apparatus of claim 11, wherein the at least one channel of the first plurality of channels at least partially overlaps the adjacent channel of the first plurality of channels in a circumferential direction.

15. The apparatus of claim 11, wherein a cross-section of the at least one channel of the first plurality of channels comprises a major axis having a greater length than a minor axis thereof.

16. The apparatus of claim 11, wherein each channel of the first plurality of channels ends at a circumferential location where a circumferentially neighboring channel of the first plurality of channels begins such that there are no sections of the wall of the first heat exchange section lacking a channel in the radial direction.

17. A heat exchanger, comprising:

a body having an inner surface and an outer surface opposing the inner surface, the body comprising:

a first heat exchange section comprising a first plurality of channels extending along a longitudinal axis of the body between the inner surface and the outer surface, the first heat exchange section having a length along the longitudinal axis greater than a thickness of the first heat exchange section in a direction perpendicular to the longitudinal axis, the first plurality of channels comprising:

a first channel;

a second channel adjacent to the first channel, the first channel and the second channel positioned to be intersected by a line extending in the direction perpendicular to the longitudinal axis;

a second heat exchange section comprising a second plurality of channels extending along the longitudinal axis and in communication with the first plurality of channels; and a weld joint coupling the first heat exchange section and the second heat exchange section extending around an interface between the first heat exchange section and the second heat exchange section.

18. The heat exchanger of claim 17, wherein a size of each channel of the first plurality of channels is substantially the same.

19. The heat exchanger of claim 17, wherein the inner surface of the body defines a passage.

20. The heat exchanger of claim 17, wherein each channel of the first plurality of channels is equally spaced from neighboring channels.

21. The heat exchanger of claim 17, wherein the first channel and the second channel are positioned to be intersected by an additional line extending in an additional direction perpendicular to the longitudinal axis and perpendicular to the line.

22. The heat exchanger of claim 17, wherein the body has a circular cross-sectional shape.

* * * * *